US005253986A

United States Patent [19]

Bond et al.

[11] Patent Number: 5,253,986

[45] Date of Patent: Oct. 19, 1993

[54] IMPELLER-TYPE PUMP SYSTEM

[75] Inventors: John C. Bond; Homer E. Gravelle, both of Arvada; William J. Mabe, Thornton, all of Colo.

[73] Assignee: Milton Roy Company, Arvada, Colo.

[21] Appl. No.: 882,454

[22] Filed: May 12, 1992

[51] Int. Cl.[5] ..... F04B 17/00

[52] U.S. Cl. ..... 417/420; 417/423.9; 417/423.11; 417/423.12; 415/143; 415/170.1; 415/106

[58] Field of Search ..... 417/423.6, 420, 423.9, 417/423.11, 423.12, 423.14; 415/143, 170.1, 104, 106, 107

[56] References Cited

U.S. PATENT DOCUMENTS

| | | | |
|---|---|---|---|
| 2,885,126 | 5/1959 | Hudson | 417/420 |
| 3,089,514 | 5/1963 | Sudmeier . | |
| 3,195,035 | 7/1965 | Sudmeier . | |
| 3,420,184 | 1/1969 | Englesberg et al. . | |
| 3,512,901 | 5/1970 | Law . | |
| 3,572,981 | 3/1971 | Pearson et al. | 417/415 |
| 3,584,975 | 6/1971 | Frohbieter . | |
| 3,635,579 | 1/1972 | Wood | 417/423.12 |
| 3,639,073 | 2/1972 | Beck, Jr. et al. | 415/109 |
| 3,677,659 | 7/1972 | Williams | 415/143 |
| 3,680,984 | 8/1972 | Young et al. | 417/420 |
| 3,767,330 | 10/1973 | Signorile . | |
| 3,904,308 | 9/1975 | Ribaud | 415/143 |
| 4,142,839 | 3/1979 | Davis et al. | 415/143 |
| 4,256,436 | 3/1981 | Fandrey et al. | 415/143 |
| 4,304,532 | 12/1981 | McCoy . | |
| 4,615,662 | 10/1986 | Laing . | |
| 4,754,181 | 6/1988 | Mizobuchi et al. . | |
| 4,806,080 | 2/1989 | Mizobuchi et al. | 417/353 |
| 4,838,763 | 6/1989 | Kramer et al. . | |
| 4,867,633 | 9/1989 | Gravelle . | |
| 5,061,151 | 10/1991 | Steiger . | |

FOREIGN PATENT DOCUMENTS

| | | | |
|---|---|---|---|
| 41992 | 2/1987 | Japan | 417/420 |
| 237093 | 10/1987 | Japan | 417/420 |
| 66490 | of 1989 | Japan . | |
| 35098 | 2/1989 | Japan | 415/104 |
| 2058062 | 9/1979 | Netherlands | 417/420 |
| 3603812 | 8/1987 | Netherlands | 415/104 |
| 556140 | 4/1957 | Sweden | 417/420 |

*Primary Examiner*—Richard A. Bertsch
*Assistant Examiner*—Roland McAndrews
*Attorney, Agent, or Firm*—Wood, Phillips, VanSanten, Hoffman & Ertel

[57] ABSTRACT

An impeller-type pump system includes a housing defining a pump chamber and a fluid inlet communicating with the chamber. An impeller is rotatably mounted in the pump chamber downstream of the inlet. The impeller includes a rear magnet hub mounting an axially facing driven magnetic coupling. Bearings are provided about the outside of the impeller for rotatably mounting the impeller in the pump chamber. Ceramic barrier discs are located behind the impeller to define a closure sealing the rear of the pump chamber. Ball bearings are mounted in a cup-shaped recess in the rear face of the magnet hub and bearing against the ceramic barrier discs at least during start-up of the pump. The sidewalls of the recess diverge away from the ceramic barrier discs, whereby the ball bearings move away from the ceramic barrier discs under centrifugal force in response to rotation of the impeller.

13 Claims, 3 Drawing Sheets

IMPELLER-TYPE PUMP SYSTEM

FIELD OF THE INVENTION

This invention generally relates to the art of centrifugal pumps and, particularly, to an impeller-type pump system which is magnetically driven.

BACKGROUND OF THE INVENTION

Centrifugal liquid pumps are used in many environments or applications. Such devices conventionally include a housing defining a pump chamber or cavity within which an impeller assembly is rotated. The impeller assembly is mounted on a shaft rotatably journalled within the housing and including radially projecting impeller blades for drawing fluid into an inlet of the housing and discharging through an outlet. Bearings are provided about the impeller shaft, usually behind the impeller, to journal the shaft within the housing. A pressure balance chamber may be provided behind the impeller to reduce axial thrust loads, thereby increasing the life or reducing the size or quantity of the thrust bearings. Such pump systems commonly are of a seal type design and may employ single, tandem or double seal systems along a shaft as is deemed desirable in particular applications. These sealed pumps attempt, as much as possible, to contain the process fluid and to prevent fluid entry into the gear box or other driving components in gear driven high speed units.

However, sealless pumps, that is, pumps without shaft seals, are being employed in increasing numbers due to environmental concerns and, in some instances, in response to mandated legislation. These pumps typically are considered as being desirable when used with fluids which are hazardous, polluting or expensive. Generally, sealless pumps are more expensive and less efficient than the more common pumps described above, but these disadvantages are considered the price to be paid for a clean environment.

Generally, mainline electric driven sealless pump technology can be broken down into two concepts, namely a canned electric motor driven pump and a magnetic coupling driven pump. An inherent limitation of the canned motor pump concerns the skin friction loss of the submerged drive motor which imposes a viable speed limit, i.e. a head capability limit. Skin friction loss is the drag or resistance of the process fluid on the motor rotor. Series staging or series arranged canned motor pump components constitute complex and costly means of circumventing this limitation and are infrequently utilized. Conversely, modern design utilizing potent rare earth permanent magnets incurs relatively low skin friction loss in magnetic drives, thereby allowing practical high speed operation, i.e. high head design. Concentric arrangements of magnets generally are used, particularly for high torque applications, i.e. greater than one horsepower.

Permanent magnet driven pumps may be of the more common concentric magnetic geometry or may be of a less common axially facing magnetic geometry. Concentric magnetic arrangements have the advantage of producing only torque forces while the axial geometry imposes axially attractive forces on the drive and driven shafts, in addition to the prime objective of drive torque. The need to handle substantial axial thrust could impose serious disadvantages in pump design, particularly in the driven half of the magnetic coupling where the process fluid must serve as a lubricant. However, this disadvantage can be compensated for if the axial magnetic geometry is used in conjunction with a hydraulic thrust balance system where available hydraulic force easily accommodates the magnetic attraction force. Such thrust balance systems are shown in U.S. Pat. Nos. 4,867,633 to Gravelle, dated Sep. 19, 1989, and 5,061,151 to Steiger, dated Oct. 29, 1991, both of which are assigned to Sundstrand Corporation.

This invention is directed to various improvements in a sealless centrifugal pump of the impeller-type which employs an axial permanent magnet geometry in conjunction with a hydraulic thrust balance system.

SUMMARY OF THE INVENTION

An object, therefore, of the invention is to provide a new and improved impeller-type pump system incorporating axially facing magnets, the system being hydraulically thrust balanced.

In the exemplary embodiment of the invention, the impeller-type pump system includes housing means having interior wall means defining a pump chamber and a fluid inlet communicating with the chamber. Impeller means are rotatably mounted in the pump chamber downstream of the inlet. The impeller means include an inducer stage forward of a centrifugal impeller stage. The invention contemplates that the impeller means not be rotatably mounted on a conventional bearing-supported shaft means, but that the impeller means be rotatably mounted in the pump chamber by radial bearing means disposed outside the impeller means, the bearing means being sandwiched between the impeller means and the interior wall means of the pump chamber.

As disclosed herein, the impeller means include a hub behind the centrifugal impeller stage. The bearing means include first and second bearings, one of the bearings being located about the hub and the other bearing being located forwardly thereof. The hub mounts an axially facing magnetic drive coupling, with the one bearing located thereabout to minimize overall parasitic drag caused by fluid friction. The impeller means, hub and magnetic coupling comprise a unitary structure supported within the pump chamber by the outside bearing means. Therefore, the impeller structure can be readily pressure balanced.

Another feature of the invention is the provision of ball bearing means mounted in an axially rearwardly opening recess means in the impeller means. The ball bearing means bear against a closure means behind the impeller means, at least during start-up of the pump. The ball bearing means include a plurality of ball bearings radially captured by sidewalls of the recess means, the sidewalls diverging away from the closure means, whereby the ball bearings move away from the closure means under centrifugal force in response to rotation of the impeller means. In the preferred embodiment of the invention, the recess means is cup-shaped and located concentric with the axis of rotation of the impeller means.

A further feature of the invention is providing the closure means behind the impeller means as a ceramic barrier. Specifically, the ceramic barrier is formed by a pair of thin, juxtaposed discs. The discs are fabricated of zirconia ceramic material, and the discs are heat shrunk within a circular opening at the rear of the pump chamber.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
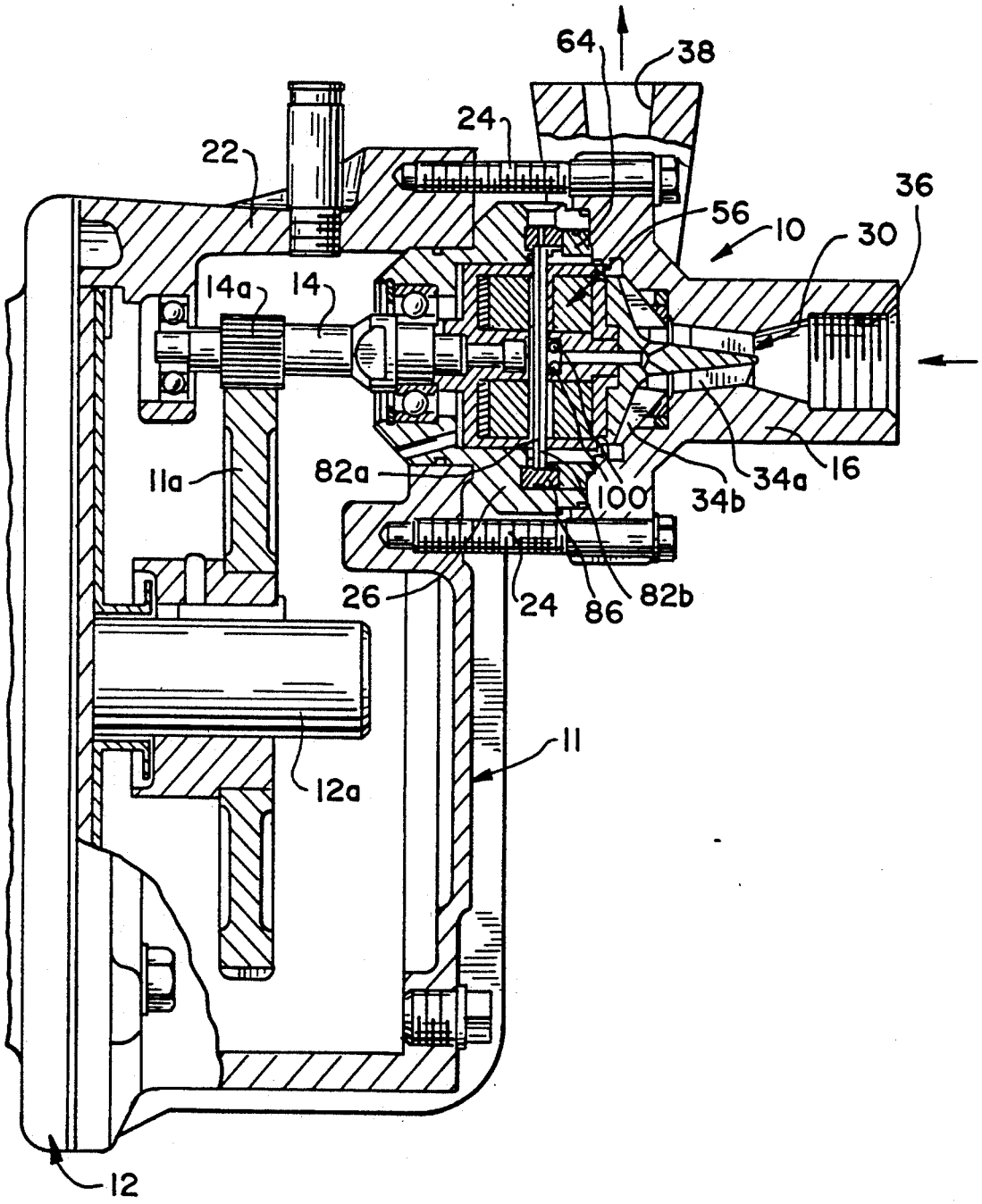
FIG. 1 is an axial section through a magnetic drive pump incorporating the concepts of the invention, the pump being attached to a gearbox and drive motor.
Figure 2:
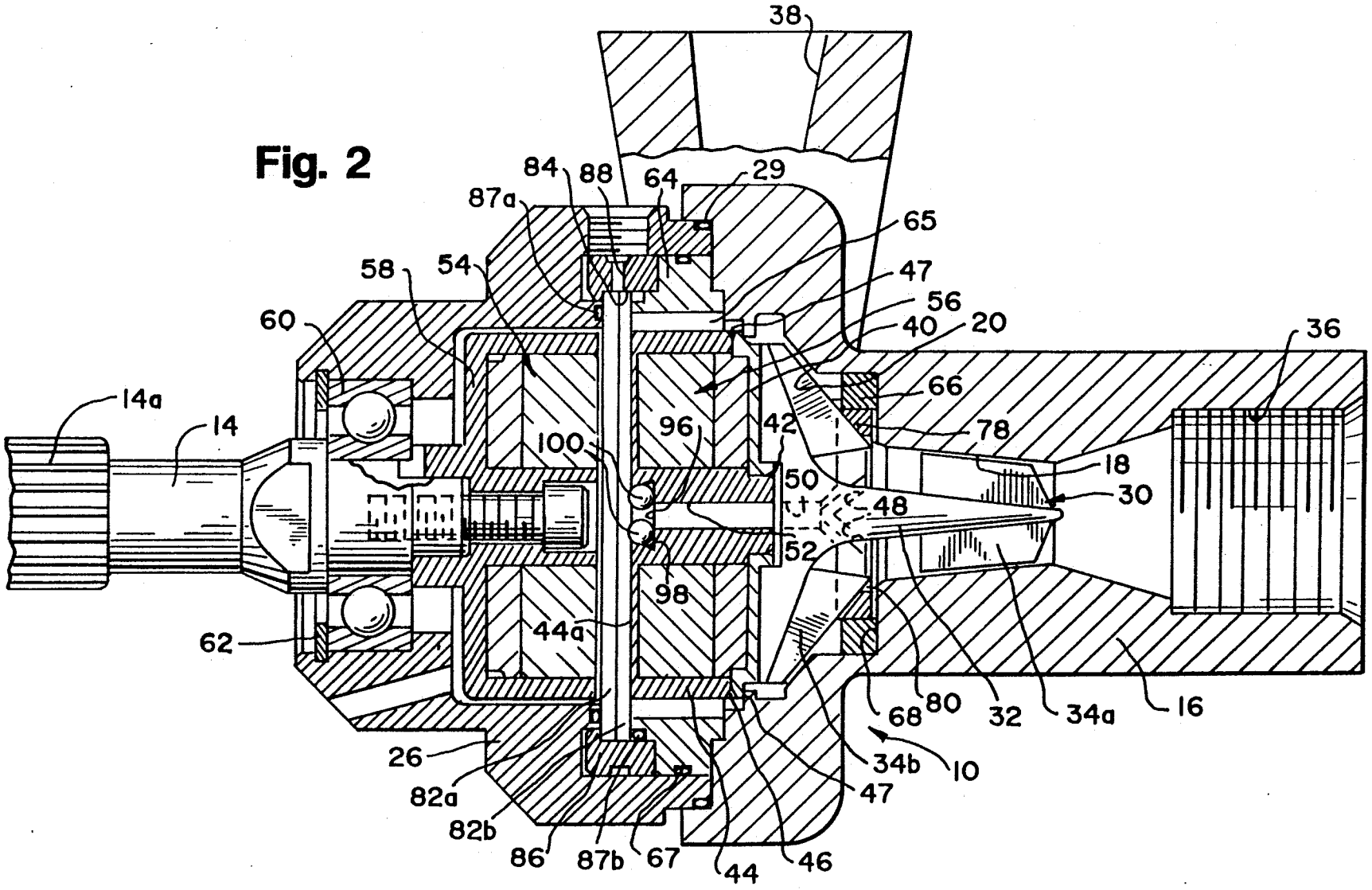
FIG. 2 is an axial section through the magnetic drive pump removed from the gearbox.

Referring to the drawings in greater detail, and first to FIGS. 1 and 2, the invention is embodied in an impeller-type centrifugal pump system, generally designated 10. FIG. 1 shows the pump system incorporated with an attached high speed gearbox, generally designated 11, and a drive motor, generally designated 12, and FIG. 2 shows the pump system removed from gearbox 11 for clarity. Consequently, like numerals are applied in both FIGS. 1 and 2 to designate like components of impeller-type centrifugal pump system 10.

In FIG. 1, drive shaft 14 has an integral gear portion 14*a* in mesh with a gear 11*a* within gearbox 11. Gear 11*a* is fixed to a drive shaft 12*a* projecting into the gearbox from drive motor 12. The shaft 14 may be driven at speeds ranging from 13,000 to 32,000 rpm.

More particularly, pump system 10 includes a front housing 16 defining a main pump chamber or cavity having a forward chamber portion 18 and a rear chamber portion 20. In the drive motor embodiment of FIG. 1, front housing 16 is clamped to a gearbox housing 22 by bolts 24, sandwiching a rear housing 26 of the centrifugal pump system therebetween. A ring seal 29 is disposed between the front and rear housings. Front housing 16 preferably is fabricated of corrosion resistant steel, such as Series 300 stainless steel.

Impeller means, generally designated 30, are rotatably mounted within the pump chamber of front housing 16 and include a hub 32 with helical inducer blades 34*a* and main impeller blades 34*b* projecting radially outwardly from the hub into forward chamber portion 18 and rear chamber portion 20, respectively. The impeller functions to draw fluid into an inlet 36 of front housing 16 and discharges through an outlet 38 of the housing. Therefore, the impeller pump is a two-stage pump, in that impeller blades 34*a* within forward chamber portion 18 define an inducer stage and impeller blades 34*b* within rear chamber portion 20 define a centrifugal impeller stage.

Impeller 30 is part of an impeller assembly in which the rear of hub 32 is fixed to an impeller plate 40, as by welds 42. The impeller rear shroud plate is fixed on a magnet hub or casing 44, as by a peripheral weld 46. Therefore, the impeller assembly is a unitary rigid, rotatable structure. Magnet hub or casing 44 includes an integral thin wall 44*a* to completely encase its magnet assembly, described hereinafter, and thereby protect the magnet assembly from process fluid.

The impeller-type centrifugal pump includes a system for pressure balancing the impeller assembly by communicating the inlet side of impeller 30 to the back side of the impeller assembly. Hydraulic thrust balance is achieved and continuously maintained by axial movement of the impeller to modulate an axial gap 47 between plate 40 and housing 16. Leakage flow from the impeller outlet passes through gap 47, through bearing slots 65, radially inward between thin wall 44*a* and ceramic disc 82*b*, and returns to the impeller inlet through passages 52 and 48. This controls the magnitude of pressure acting on the backside of the impeller whereby an outward force resulting therefrom counterbalances an inward thrust force from pressure acting on the front of the impeller. Radial passages 48 in impeller hub 32 communicate with an axial passage 50 in the hub and which, in turn, communicates with an axial passage 52 in magnet hub or casing 44 leading to the back side of the impeller assembly. Therefore, due to the pressure balancing of the impeller assembly, axial thrust loads on the impeller assembly are eliminated.

The impeller assembly, including impeller 30, is rotated by an axially facing permanent magnet arrangement or magnetic coupling which includes an axially facing drive magnet assembly, generally designated 54, and a driven magnet assembly, generally designated 56. Drive magnet assembly 54 is mounted within a magnet hub 58 fixed to drive shaft 14. The drive shaft is rotatably mounted within rear housing 26 by appropriate bearing means 60 secured within the rear housing by a locking ring 62. Therefore, as shaft 14 rotates drive magnet assembly 54, the drive magnet assembly is flux coupled to driven magnet assembly 56 to rotate the impeller assembly including impeller 30.

The invention contemplates that the unitary impeller assembly, including impeller 30 and driven magnet assembly 56, be rotatably mounted within the pump chamber of front housing 16 by radial bearing means located outside of and surrounding the impeller assembly. More particularly, the bearing means include a first annular bearing 64 surrounding magnet hub 44 and a second annular bearing 66 surrounding impeller 30. With first bearing 64 surrounding the magnet hub, the bearing is outside driven magnet assembly 56 and thereby minimizes parasitic drag. A ring seal 67 surrounds the outside of first bearing 64, between the bearing and rear housing 26.

Second annular bearing 66 is seated against an interior shoulder 68 of front housing 16 and bears against an impeller ring 78 fixed to the impeller, as by welds 80. With bearings 64 and 66 being located outside the impeller assembly, no centerline support shaft or centrally located bearings are required.

The invention contemplates a novel barrier means defining a closure means for the rear of the pump chamber of the impeller assembly to provide a sealless pump and to prevent fluid from entering the drive components of the pump as well as gearbox 11. More particularly, an axially spaced pair of zirconia ceramic discs 82*a* and 82*b* are juxtaposed and disposed within a circular opening 84 defined in a retainer ring 86 sandwiched between bearing 64 and rear housing 26. A first ring seal 87*a* is disposed between rearward disc 82*a* and rear housing 26, and a second ring seal 87*b* is disposed between forward disc 82*b* and bearing 64. The double barrier configuration provides maximum protection against overboard leakage, even under rare circumstances such as extreme thermal shock. Each ceramic disc 82*a*, 82*b* possesses sufficient strength to, alone, contain the pump hydrostatic design pressure.

In assembly, the retainer ring 86 is heated then shrunk onto ceramic discs 82*a* and 82*b* to develop compressive stresses to resist tensile stresses caused by pressure loading. This minimizes the ceramic thickness because compressive strength typically is much greater than tensile strength. By minimizing the thickness of the ceramic discs, maximum torque is achieved due to the reduced gap between magnet assemblies 54 and 56. The thicknesses and axial spacing of the ceramic discs are chosen so that the fluid side disc 82*b* will rupture if overpressurized or damaged. In other words, ceramic disc 82*b* may be thinner than ceramic disc 82*a*. A radial port 88 is provided through retainer ring 86 and can be placed in communication with a leak detector which, in turn, can initiate an alarm or shutdown.

In essence, a good barrier material for forming a closure means at the rear of the pump chamber should possess low electrical conductivity and low permeability to minimize eddy current loss and heat build-up. This consideration becomes increasingly important in high speed design because of the high rate at which flux lines cut the barrier material. Consequently, zirconia ceramic material has been chosen for the barrier discs.

Figure 3:
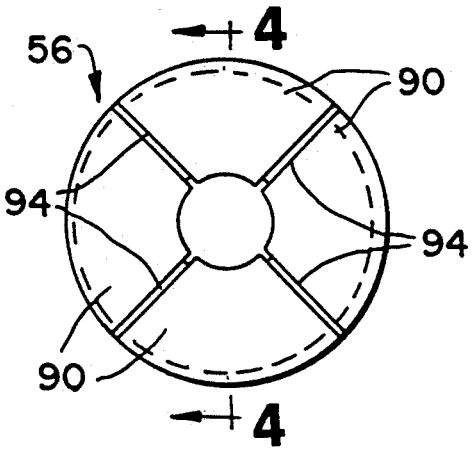
FIG. 3 is an axial elevational view of the magnetic coupling of the pump impeller assembly.
Figure 4:
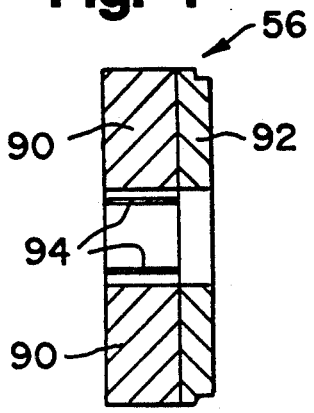
FIG. 4 is a vertical section taken generally along line 4—4 of FIG. 3.

Referring to FIGS. 3 and 4, driven magnet assembly 56 is shown. However, it should be understood that drive magnet assembly 54 can be similarly constructed.

More particularly, magnet assembly 56 includes four separate pie shaped magnet segments 90 attached to a backing iron 92 by an epoxy type adhesive so that the magnet segments will not move out of place when attracted by other magnet segments. The magnet segments are separated by thin non-magnetic keys 94 which fit in shallow radial key slots in backing iron 92. The backing iron closes the magnetic flux field behind the magnets opposite from the inter-magnetic gap between drive magnet assembly 54 and driven magnet assembly 56. In the backing iron, the flux is angularly directed to the adjacent magnetic pole of different polarity. In essence, the backing iron captures or traps the magnetic field within the iron.

Figure 5:
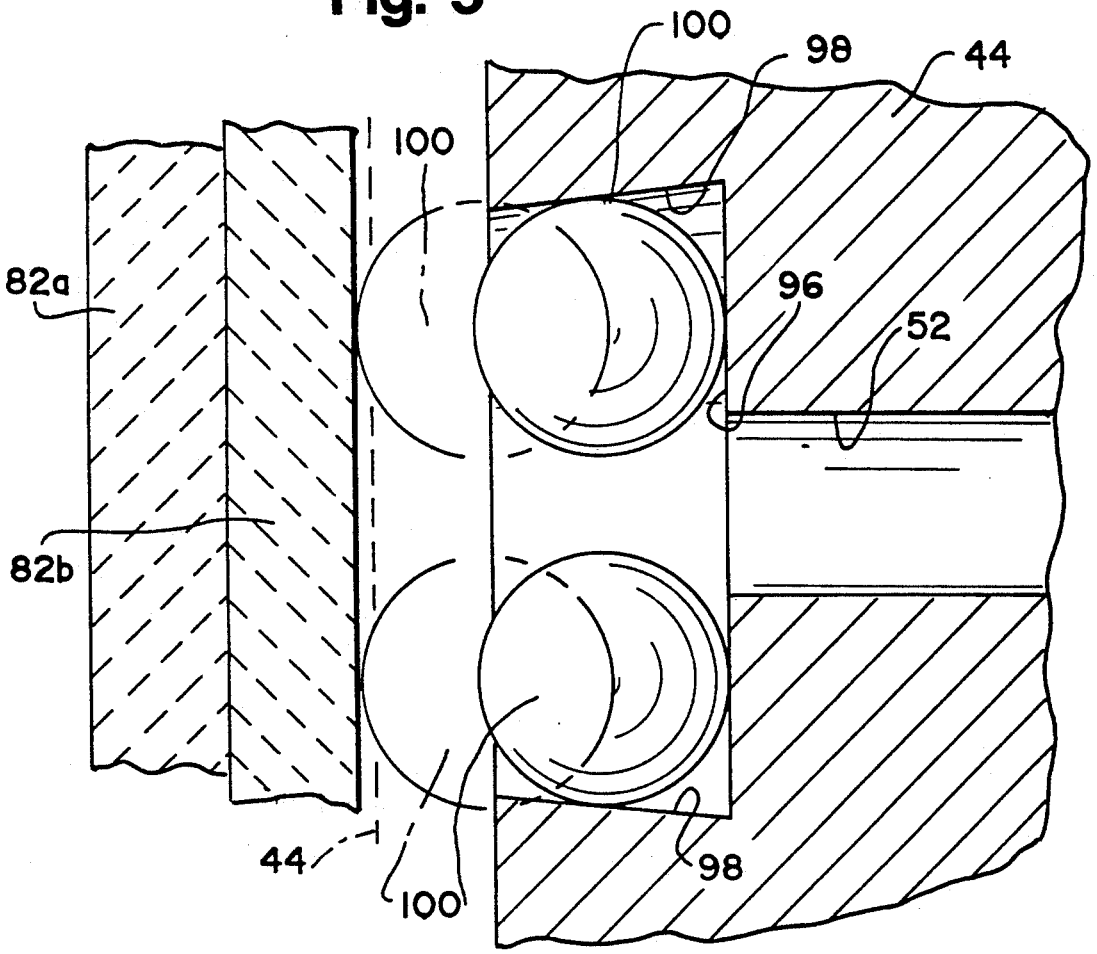
FIG. 5 is an enlarged, fragmented axially section through the ball bearing means at the rear of the impeller assembly.

Generally, the invention contemplates the provision of thrust ball bearing means mounted in an axially rearwardly opening recess means in the impeller assembly, with the barrier means defining the rear of the pump chamber, particularly, ceramic disc 82*b*. Specifically, referring to FIG. 5, a cup-shaped recess 96 is formed in the rear face of the impeller assembly about centerline axial passage 52 through magnet hub 44. The recess has sidewalls 98 which diverge radially outwardly away from the barrier means defined by the ceramic disc. A plurality of balls 100 (such as three balls) are disposed in recess 96 and are radially captured by diverging walls 98. Clearance is provided between the array of bearing balls for fluid communication therebetween with passage 52. The thrust ball bearing means is provided because a critical consideration in magnetic drives is to assure that magnetic decoupling does not occur due to start up friction since this would result in a complete stall that can be rectified only by a shut down and restart.

More particularly, axially facing coupled magnets exert axial forces which are compensated for dynamically by the hydraulic thrust balance system described above, but the axial forces cause the impeller assembly to bear hard against the barrier provided by the ceramic discs. Start-up friction must be such that torque is within the capacity of the magnetic coupling. These considerations are resolved by the thrust ball bearing means. The balls provide low rolling friction at start-up, as shown in phantom in FIG. 5, and the balls "lift off" of the barrier provided by ceramic disc 82*b* when the rotational speed of the impeller assembly has increased sufficiently to balance the impeller hydraulic thrust, as shown in full lines in FIG. 5. This typically will occur in a fraction of a second. Coast-down at pump shutdown where rolling contact reoccurs also is very brief. By locating the ball bearings in a pitch circle about the centerline of the impeller assembly, the ball pitch circle can be very small, as shown, so that rolling speeds are not excessive, and the rolling balls continuously expose new surfaces to contact. With the ball cup walls 98 diverging radially away from ceramic disc 82*b*, centrifugal force acts to preclude ball contact with the disc under steady state operating conditions. Because of the limited contact by the balls, ball bearings of conventional alloy steel can be employed.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An impeller-type pump system, comprising:

housing means defining a pump chamber and a fluid inlet communicating with the chamber;

an impeller assembly rotatably mounted in the pump chamber downstream of the inlet, the impeller assembly including a forward impeller means and a rearward magnet hub mounting a driven magnetic coupling member;

bearing means rotatably mounting the impeller means in the pump chamber, the bearing means engaging the outside of the magnet hub to minimize overall parasitic drag;

separator means disposed adjacent the driven magnetic coupling member and closing the pump chamber;

means communicating pump discharge pressure to the back side of the magnetic coupling member for axially balancing the impeller in the pump chamber;

a magnetic drive member rotatably mounted in the housing on the opposite side of the separator; and gearing mounted in the housing and connected to drive the magnetic drive member.

2. A pump comprising:

housing means defining a pump chamber including an axial inlet communicating with the chamber;

impeller means rotatably mounted in the chamber;

bearing means radially supporting the impeller means in the pump chamber the bearing means engaging the outside of the magnet hub to minimize overall parasitic drag;

a hub on the impeller including a magnetically driven coupling member;

separator means disposed adjacent the magnetically driven coupling member and closing the pump chamber;

an outlet leading from the pump chamber;

means communicating discharge pressure adjacent the outlet to the back side of the magnetic coupling member for axially balancing the impeller in the pump chamber;

a magnetic drive member rotatably mounted in the housing on the opposite side of the separator; and high speed gearing mounted in the housing and connected to drive the magnetic input member at high speeds.

3. An impeller-type pump system, comprising:

housing means defining a fluid inlet;

impeller means rotatably mounted in the housing means downstream of the inlet;

barrier means axially rearwardly of the impeller means; and ball bearing means mounted in an axially rearwardly opening recess means in the impeller means, the ball bearing means bearing against the barrier means at least during start-up of the pump, and the ball bearing means being radially captured by sidewall means of the recess means, the sidewall means diverging away from the barrier means whereby the ball bearing means move away from the barrier means under centrifugal force in response to rotation of the impeller means.

4. The impeller-type pump system of claim 3 wherein said barrier means define a face engageable by the ball bearing means.

5. The impeller-type pump system of claim 4 wherein said recess means is cup-shaped, and said ball bearing means are located therein.

6. The impeller-type pump system of claim 5 wherein said cup-shaped recess is located concentric with the axis of rotation of the impeller means.

7. An impeller-type pump system, comprising;

housing means defining a pump chamber and a fluid inlet communicating with the chamber;

impeller means rotatably mounted in the pump chamber downstream of the inlet, the impeller means including an axially facing magnetic coupling member at the rear thereof; and a pair of axially spaced thin, radially disposed, juxtaposed discs behind the impeller means to define a closure sealing the rear of the pump chamber, the disc closest to the impeller means being thinner than the other disc of the pair thereof.

8. The impeller-type pump system of claim 7 wherein said discs are fabricated of ceramic material.

9. The impeller-type pump system of claim 7 including a retainer ring supporting the discs, the retainer ring having been heat shrunk on the discs to develop compressive stress resisting tensile stress caused by pressure loading.

10. An impeller-type pump system, comprising;

housing means defining a pump chamber and a fluid inlet communicating with the chamber;

impeller means rotatably mounted in the pump chamber downstream of the inlet, the impeller means including an axially facing magnetic coupling member at the rear thereof; and ceramic barrier means behind the impeller means to define a closure member sealing the rear of the pump chamber, said ceramic barrier means comprising a retainer ring which has been heat shrunk onto at least one ceramic closure member within a complementary surrounding opening at the rear of the pump chamber.

11. The impeller-type pump system of claim 10 wherein said ceramic closure member comprises a radially disposed disc.

12. The impeller-type pump system of claim 10 wherein said ceramic barrier means comprise a pair of thin, radially disposed, axially spaced discs, the disc closest to the impeller means being thinner than the other disc of the pair thereof.

13. The impeller-type pump system of claim 10 wherein said closure member is fabricated of zirconia ceramic material.

* * * * *